United States Patent [19]

Emerson

[11] Patent Number: 4,500,221

[45] Date of Patent: Feb. 19, 1985

[54] MARKER HOLDER APPARATUS

[76] Inventor: Clarence A. Emerson, 203 E. Birch, Bozeman, Mont. 59715

[21] Appl. No.: 307,617

[22] Filed: Oct. 1, 1981

[51] Int. Cl.[3] ..... B43K 23/00; B43K 21/06

[52] U.S. Cl. ..... 401/82; 401/84

[58] Field of Search ..... 401/82, 83, 84, 88

[56] References Cited

U.S. PATENT DOCUMENTS

| | | | |
|---|---|---|---|
| 575,275 | 1/1897 | Ress | 401/83 |
| 1,494,736 | 5/1924 | Cottrell | 401/83 |
| 2,025,938 | 12/1935 | DeMario | 401/82 X |
| 2,257,529 | 9/1941 | Mattos | 401/82 |
| 2,555,063 | 5/1951 | Soifer | 401/83 |
| 3,756,727 | 9/1973 | Gallagher | 401/84 |

FOREIGN PATENT DOCUMENTS

| | | | |
|---|---|---|---|
| 70798 | 1/1948 | Denmark | 401/82 |
| 426771 | 4/1935 | United Kingdom | 401/84 |

*Primary Examiner*—Steven A. Bratlie
*Attorney, Agent, or Firm*—Arthur L. Urban

[57] ABSTRACT

Marker holder apparatus including a guide portion and an advancing portion; the guide portion including an elongated member with an open longitudinal slot, the elongated member including a bottom section, sidewall sections extending substantially perpendicularly from the longitudinal edges of the bottom section, flange sections extending from longitudinal edges of the sidewall sections remote from the bottom section, the flange sections extending toward one another substantially parallel to the bottom section, a stop section disposed adjacent one end of the elongated member, biasing mechanism located adjacent the end of the elongated member remote from the stop section, a plurality of spaced openings along the length of each of the sidewall sections, the openings in one of the sidewall sections being spaced therealong at points corresponding to the openings in the other of the sidewall sections; the advancing portion including an arcuate strip section disposed within the elongated member with each free end thereof being disposed adjacent a sidewall section, connector sections extending from the strip section across the flange sections from the free edges to the outer edges thereof, actuator sections extending from the connector sections along the sidewall sections and spaced therefrom, opening-engaging sections extending from the arcuate strip section adjacent the connector sections, the opening-engaging sections extending from the strip section partway toward the actuator section.

7 Claims, 5 Drawing Figures

MARKER HOLDER APPARATUS

This invention relates to a novel holder apparatus and more particularly relates to a new apparatus for holding a marker.

Markers have been used throughout the ages. Originally, markers were pieces of natural material such as coal, stone, inks from plant materials and the like. Some marker materials commonly were used as they were found. With other marking substances the materials might be mixed or dissolved in water to make their use more convenient.

As civilization developed, it was found that the natural marker materials were not satisfactory in all situations. As a result, some natural materials were modified to render them more convenient for use. An example of such a modified material is chalk which is frequently pressed into sticks. Another example is pencil lead which is graphite formed into a stick and inserted into a wooden cylinder. Also, synthetic materials such as inks and the like were developed for special uses.

One of the problems encountered with marker materials is the fact that the material not only marks the desired surface but also the material discolors any other surface with which it comes into contact. The user's hands, clothing and the like become discolored. While the user can use a high degree of care with the marker material to avoid accidental contact with surfaces, the method employed in its application might require that there be some contact with surrounding surfaces.

Solid markers ordinarily are handled directly so that the material rubs off onto the hands. If the material is easily removable from the hands, most users do not bother to protect their hands but simply clean their hands after using the marker. If the material cannot be removed from the hands easily, many people try to use some protective surface on their hands or on the marker material.

Cases, sheaths, coverings and the like have been developed to protect the user from the marking material. Sometimes cases are required to reduce the incidence of breakage of the marker material. As more and more different markers have become available in recent years, the protective cases and coverings for the markers also have become more individualized.

One type of marker which commonly has been used with a holder is soapstone that is used to mark metal for welding, cutting, bending and the like. U.S. Pat. No. 3,756,727 is directed to one form of soapstone holder. The patent described a holder which utilizes an indexing member that slides along an elongated receptacle. The receptacle has top flanges with openings along their length. The indexing member has a pair of projecting elements that are selectively engageable with one pair of the openings. Movement of the indexing member is effected by depressing a portion of the indexing member which projects between the flanges.

While the device of the above patent provides a holder for a soapstone stick, the holder may present problems in use. The projecting portion of the indexing member is located opposite to a pocket clip. In removing the holder from a pocket, the projection may be depressed accidentally causing the position of the soapstone to change from that desired.

Also, with the holder of the above patent, only a single projection is employed. This can increase the chance of accidentally activating the indexing member, particularly in view of its exposed location. In addition, the front projection increases the thickness of the holder in a pocket which may be undesirable. Furthermore, the design of the indexing member retains an end of the soapstone therein so the marker must be removed from the holder to use the last part of the soapstone.

The present invention provides a novel holding apparatus for a marker. The marker holder apparatus of the invention minimizes accidental movement of the marker therein. The holder apparatus of the invention is thin in profile and can be carried conveniently in a pocket without significant bulging. The apparatus is capable of holding even short pieces of the marker so that waste is minimized.

The marker holder apparatus of the invention is simple in design and relatively inexpensive. The holder apparatus can be fabricated from commercially available materials and components. Conventional tool manufacturing procedures and techniques may be utilized in the fabrication. The marker holder apparatus is durable in construction and has a long useful life.

The holder apparatus of the invention is convenient to use with a minimum of instruction. A marker stick can be inserted into the holder easily and quickly.

Other benefits and advantages of the novel marker holder apparatus of the present invention will be apparent from the following description and the accompanying drawings in which.

Figure 1:
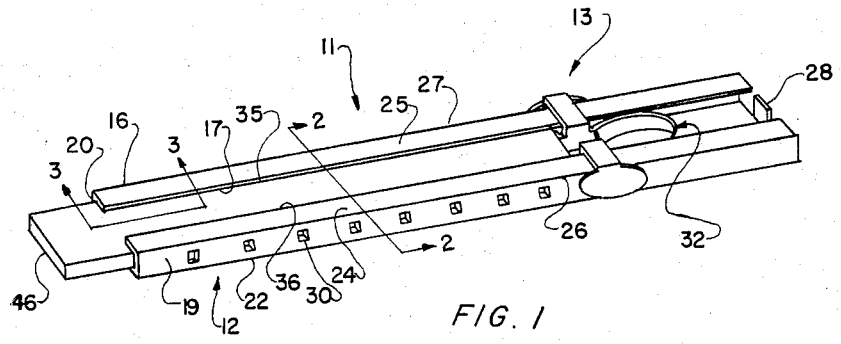
FIG. 1 is a view in perspective of one form of the marker holder apparatus of the invention.
Figure 2:
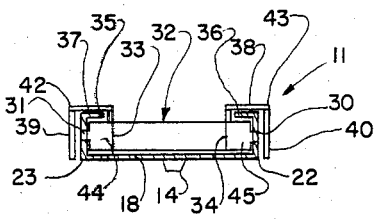
FIG. 2 is an enlarged sectional view taken along line 2—2 of FIG. 1.
Figure 4:
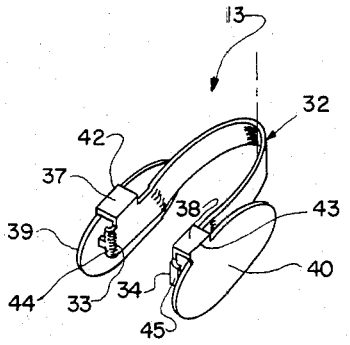
FIG. 4 is an enlarged view in perspective of the advancing portion of the marker holder apparatus shown in FIG. 1.
Figure 3:
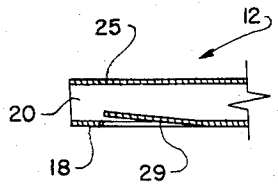
FIG. 3 is an enlarged fragmentary sectional view taken along line 3—3 of FIG. 1.
Figure 5:
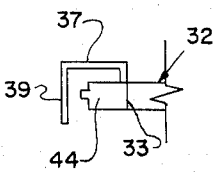
FIG. 5 is an enlarged fragmentary end view of the advancing portion shown in FIG. 4.

As shown in the drawings, one form of the novel marker holder apparatus 11 of the invention includes a guide portion 12 and an advancing portion 13. Advantageously, the guide and advancing portions 12 and 13 are each formed as unitary structures. Preferably, a clip member 14 is mounted on the guide portion 12. This construction facilitates carrying and storage of the apparatus in a pocket.

The guide portion 12 of the marker holder apparatus 11 of the invention includes an elongated member 16 with an open longitudinal slot 17. The elongated member 16 includes a bottom section 18 and sidewall sections 19 and 20. The sidewall sections 19 and 20 extend substantially perpendicularly from longitudinal edges 22 and 23 of the bottom section 18. The sidewall sections 19 and 20 advantageously have heights less than the width of the bottom section.

Flange sections 24 and 25 extend from longitudinal edges 26 and 27 of sidewall sections 19 and 20, respectively. The flange sections 24 and 25 extend toward one another substantially parallel to the bottom section 18. Advantageously, the bottom section 18, the sidewall sections 19 and 20 and the flange sections 24 and 25 form an elongated member 16 with a generally rectangular crosssectional configuration.

The elongated member 16 further includes a stop section disposed adjacent one end thereof. The stop section advantageously may include a section 28 extending from the bottom section 18 as shown in the drawings.

Biasing means are located adjacent the end of the elongated member 16 remote from the stop section 28. The biasing means preferably may be a section 29 cut from the bottom section 18 with the cut section being bent slightly into the interior of the elongated member 16.

A plurality of openings 30 and 31 are spaced along the length of each sidewall section 19 and 20, respectively. The openings 30 in sidewall section 19 are spaced therealong at points corresponding to the openings 31 in the other sidewall section 20. Advantageously, the openings 30 and 31 in the sidewall sections 19 and 20 are aligned in a straight line disposed substantially parallel to and approximately halfway between the pair of longitudinal edges 22 and 26 and the pair 23 and 27 of the sidewall sections.

The advancing portion 13 of the marker holder apparatus 11 of the present invention includes an arcuate strip section 32 disposed within the elongated member 16. The arcuate strip section 32 is disposed within the elongated member with each end 33 or 34 of the strip disposed adjacent a free edge 35 or 36 of a flange section 24 or 25.

Connector sections 37 and 38 extend from the arcuate strip section 32, preferably adjacent the free ends 33 and 34 thereof. The connector sections 37 and 38 extend across the flange sections 24 and 25 from the free edges 35 and 36 of the outer edge of each, that is, the longitudinal edges 26 and 27 of the sidewall sections 19 and 20.

Actuator sections 39 and 40 extend from the connector sections 37 and 38. The actuator sections 39 and 40 extend downwardly from the free outer ends 42 and 43 of the connector sections 37 and 38 along the outside of the sidewall sections 19 and 20. The actuator sections 39 and 40 are spaced slightly from the sidewall sections.

Opening-engaging sections 44 and 45 extend from the arcuate strip sections 32. The opening-engaging sections 44 and 45 extend from the strip section 32 adjacent the connector sections 37 and 38, and advantageously adjacent the free ends 33 and 34 of the strip section. The opening-engaging sections 44 and 45 extend from the strip section 32 partway toward the actuator sections 39 and 40. Preferably, the opening-engaging sections 44 and 45 each include a projection of reduced width as shown.

The marker holder apparatus of the invention may be fabricated from any of a variety of different materials such as metals, plastics and the like. The guide portion 12 and the advancing portion 13 advantageously are formed of metal strip or plate material bent into the desired configuration.

The marker holder apparatus 11 of the invention as shown in the drawings is assembled for use by inserting the advancing portion 13 into an end of the guide portion 12. The advancing portion is aligned with the guide portion so the connector sections 37 and 38 slide over the flange sections 24 and 25 with the opening-engaging sections 44 and 45 inside the elongated member 16 and the actuator sections 39 and 40 outside the sidewall sections 19 and 20. The advancing portion 13 is maintained within the elongated member 16 by bending the stop section 28 and the biasing cut section 29 to a position as shown in the drawings. The apparatus 11 is now ready for use.

To use the marker holder apparatus 11 of the present invention, the advancing portion 13 is retracted in the elongated member 16 until the strip section 32 bears against the stop section 28. Then, a piece of marker material such as soapstone 46 is inserted into the end of the elongated member past biasing cut section 29. The marker piece 46 is pushed into the elongated member until it contacts the free ends 33 and 34 of the arcuate strip section 32.

The marker piece 46 in holder apparatus 11 can be used in the conventional manner to mark surfaces and particularly metal surfaces such as pieces to be welded, bent, cut and similar metal working operations. With continued use, the soapstone marker wears away. When the marking edge of the soapstone nears the end of the elongated member 16, the soapstone piece is pushed forward from the elongated member a distance to present a useable free length of the soapstone.

This is accomplished with the marker holder apparatus 11 of the invention by grasping the holder between the thumb and forefinger of one hand and placing the other thumb and forefinger against the actuator sections 39 and 40. Pressure is applied to the actuator sections 39 and 40, moving them toward each other and against the sidewall sections 19 and 20 of the elongated member 16.

This movement of the actuator sections 39 and 40 overcomes the resistance of the arcuate strip section 32 and withdraws the opening-engaging sections 44 and 45 from the openings 30 and 31 in the sidewalls 19 and 20 of the elongated member 16. By continuing pressure on actuator sections 39 and 40, the advancing portion 13 can be moved along elongated member 16. This movement of the advancing portion 13 will cause the soapstone stick 46 to be pushed from the end of the elongated member a sufficient distance to provide a free end of the soapstone.

Pressure on the actuator sections 39 and 40 then is released and the advancing portion moved slightly. Thus, the opening-engaging sections 44 and 45 engage new openings 30 and 31 in the sidewall sections 19 and 20.

The above procedure is repeated each time the free end of the soapstone has become worn away. When the advancing portion 13 has pushed the soapstone completely from the elongated member 16, a new soapstone 46 is inserted into the elongated member in the same way as was done originally and the apparatus 11 again is ready for use.

The above description and the accompanying drawings show that the present invention provides a novel marker holder apparatus that minimizes accidental movement of the marker. The holder apparatus of the invention is capable of holding short pieces of the marker, thereby minimizing waste. The holder apparatus can be carried conveniently in a pocket without significant bulging.

The marker holder apparatus of the invention is simple in design and relatively inexpensive. The apparatus is durable in construction and has a long useful life. The holder apparatus can be fabricated from commercially available materials and components employing conventional tool manufacturing procedures.

The marker holder apparatus of the invention is convenient to use with a minimum of instruction, even by individuals with limited dexterity. New marker sticks can be inserted into the holder easily and quickly.

It will be apparent that various modifications can be made in the particular marker holder apparatus described in detail above and shown in the drawings within the scope of the invention. The size, configuration and arrangement of components can be changed to meet specific requirements. Also, the materials of which the apparatus is fabricated can be different. These and other changes can be made in the holder apparatus provided the functioning and operation of the apparatus are not deleteriously affected. Therefore, the scope of the invention is to be limited only by the following claims.

What is claimed is:

1. Marker holder apparatus including a guide portion and an advancing portion; said guide portion including an elongated member with an open longitudinal slot, said elongated member including a bottom section, sidewall sections extending substantially perpendicularly from the longitudinal edges of said bottom section, flange sections extending from longitudinal edges of said sidewall sections remote from said bottom section, said flange sections extending toward one another substantially parallel to said bottom section, a stop section disposed adjacent one end of said elongated member, biasing means located adjacent the end of said elongated member remote from said stop section, a plurality of spaced openings along the length of each of said sidewall sections, the openings in one of said sidewall sections being spaced therealong at points corresponding to the openings in the other of said sidewall sections; said advancing portion including an arcuate strip section disposed within said elongated member with each free end thereof being disposed adjacent a sidewall section, said strip section having a width substantially the same as the height of said elongated member, connector sections extending from said strip section across said flange sections from the free edges to the outer edges thereof, actuator sections extending from said connector sections along said sidewall sections and spaced substantially parallel therefrom, opening-engaging sections extending from said arcuate strip section adjacent said connector sections, said opening-engaging sections extending from said strip section partway toward said actuator sections, said opening-engaging sections each including a projection of reduced width extending from said arcuate strip section, said arcuate strip section biasing said opening-engaging sections toward said sidewall sections; whereby applying finger pressure to said actuator sections frees said opening-engaging sections from openings in said sidewall sections to allow said advancing portion to be moved along the length of said elongated member.

2. Marker holder apparatus according to claim 1 wherein said elongated member of said guide portion has a generally rectangular cross sectional configuration.

3. Marker holder apparatus according to claim 1 wherein said biasing means of said guide portion includes a cut section of said bottom section bent toward said flange sections.

4. Marker holder apparatus according to claim 1 wherein said stop section includes a section extending from said bottom section.

5. Marker holder apparatus according to claim 1 wherein the sections of said guide portion are formed as a unitary structure.

6. Marker holder apparatus according to claim 1 wherein the sections of said advancing portion are formed as a unitary structure.

7. Marker holder apparatus according to claim 1 including a clip member mounted on the outer surface of said bottom section of said guide portion.

* * * * *